United States Patent [19]

Bogese

[11] Patent Number: 4,553,800

[45] Date of Patent: Nov. 19, 1985

[54] LOW PROFILE MODULAR PLUG

[75] Inventor: Charles E. Bogese, Roanoke, Va.

[73] Assignee: Virginia Patent Development Corp., Roanoke, Va.

[21] Appl. No.: 434,639

[22] Filed: Oct. 15, 1982

[51] Int. Cl.[4] ..... H01R 11/00

[52] U.S. Cl. ..... 339/59 M; 339/97 P; 339/103 M; 339/107

[58] Field of Search ..... 339/91 R, 103 M, 107, 339/59 M, 176 M, 97 P, 186 M

[56] References Cited

U.S. PATENT DOCUMENTS

| | | | |
|---|---|---|---|
| D. 205,509 | 8/1966 | Reynolds . | |
| 1,984,036 | 12/1934 | Schwartzmann | 339/218 M |
| 2,294,482 | 9/1942 | Siegmund | 339/278 C |
| 2,911,612 | 11/1959 | Jackson et al. | 339/176 MP |
| 3,149,897 | 9/1964 | Martineck . | |
| 3,193,791 | 7/1965 | Bock et al. | 339/176 MP |
| 3,221,288 | 11/1965 | Eads | 339/217 R |
| 3,315,218 | 4/1967 | Aker | 339/218 R |
| 3,399,377 | 8/1968 | Warzecka | 339/176 MP |
| 3,467,942 | 9/1969 | Dell et al. | 339/91 R X |
| 3,523,269 | 8/1970 | Witek et al. | 539/91 R |
| 3,573,717 | 4/1971 | Lightner | 339/218 M |
| 3,588,784 | 6/1971 | Kunkle | 339/91 R |
| 3,617,990 | 11/1971 | Colardeau | 339/278 C |
| 3,696,319 | 10/1972 | Olsson | 339/17 F |
| 3,699,498 | 10/1972 | Hardesty et al. . | |
| 3,727,174 | 4/1973 | Podmore et al. . | |
| 3,835,445 | 9/1974 | Hardesty | 339/99 R |
| 3,850,497 | 11/1974 | Krumreich et al. . | |
| 3,860,316 | 1/1975 | Hardesty . | |
| 3,894,783 | 7/1975 | Messner . | |
| 3,990,767 | 11/1976 | Narozny | 339/97 P |
| 4,025,147 | 5/1977 | Van Arsdale et al. | 339/176 MP |
| 4,040,699 | 8/1977 | Rasmussen | 339/99 R |
| 4,046,444 | 9/1977 | Brorein | 339/91 R |
| 4,062,616 | 12/1977 | Shaffer et al. . | |
| 4,084,877 | 4/1978 | Knickerbocker | 339/217 R |
| 4,092,058 | 5/1978 | Eigenbrode | 339/218 M |
| 4,186,988 | 2/1980 | Kobler | 339/176 MP |

(List continued on next page.)

FOREIGN PATENT DOCUMENTS

| | | | |
|---|---|---|---|
| 2704760 | 8/1977 | Fed. Rep. of Germany | 339/59 M |
| 1576999 | 8/1969 | France | 339/91 |
| 1315693 | 5/1973 | United Kingdom | 339/59 M |
| 2018048 | 10/1979 | United Kingdom | 339/91 R |
| 2024537 | 1/1980 | United Kingdom | 339/59 M |

OTHER PUBLICATIONS

High-Density Cable Connector System, Mollen et al., IBM Tech. Discl. Bulletin, vol. 20, No. 11A, Apr. 1978.

*Primary Examiner*—William R. Briggs

*Attorney, Agent, or Firm*—Saidman, Sterne, Kessler & Goldstein

[57] ABSTRACT

A low profile, wide body modular plug and a multi-conductor shielded cable for termination therein and use with a low profile modular jack adapted to be mounted on a printed circuit board in a closely-spaced array. The low profile design of the plug features latching arms mounted on the outer side walls which mate with cooperating shoulders formed on the inner side walls of the jack. The plug preferably includes a flip-top door formed in the bottom wall thereof for permitting greater accessibility to the internal cable-receiving cavity of the plug. The flip-top door preferably includes a plurality of cable-engaging projections for increasing the pull-out or retention force of the cable and plug assembly. The plug is particularly designed to receive a multi-conductor shielded cable which includes three round shielded wire assemblies arranged in a planar array within an outer encapsulating jacket. Each shielded wire assembly includes a central filler surrounded by a single layer of insulated wires which are, in turn, wrapped within an outer conductive shield of foil layers or the like. One of the shielded wire assemblies includes an uninsulated ground wire located in the outer layer which serves to effectively shield each of the wire assemblies. In a preferred embodiment, up to 29 insulated conductors can be effectively shielded by a single uninsulated ground wire.

21 Claims, 5 Drawing Figures

U.S. PATENT DOCUMENTS

| | | | |
|---|---|---|---|
| 4,195,900 | 4/1980 | Hughes | 339/125 R |
| 4,202,593 | 5/1980 | Abernethy et al. | 339/125 R |
| 4,210,376 | 7/1980 | Hughes et al. . | |
| 4,225,205 | 9/1980 | Sinclair et al. | 339/103 M X |
| 4,225,209 | 9/1980 | Hughes | 339/126 R |
| 4,231,628 | 11/1980 | Hughes et al. | 339/17 LC |
| 4,269,467 | 5/1981 | Hughes | 339/126 R |
| 4,274,691 | 6/1981 | Abernethy et al. | 339/278 C |
| 4,280,746 | 7/1981 | Ignatowicz | 339/107 |
| 4,292,736 | 10/1981 | Hughes et al. | 29/884 |
| 4,296,550 | 10/1981 | Kobler | 29/884 |
| 4,296,991 | 10/1981 | Hughes et al. | 339/176 MP |
| 4,405,192 | 9/1983 | Eaby et al. | 339/91 R |
| 4,406,509 | 9/1983 | Jagen | 339/91 R |
| 4,413,872 | 11/1983 | Rudy, Jr. et al. | 339/59 M |
| 4,428,636 | 1/1984 | Kam et al. | 339/97 P |
| 4,457,575 | 7/1984 | Davis | 339/176 MP |

LOW PROFILE MODULAR PLUG

BACKGROUND OF THE INVENTION

1. Field of the Invention

The present invention is related generally to electrical connectors and cables utilized therewith, and more particularly is directed towards a low profile, modular plug adapted to terminate a multiconductor shielded cable so as to couple same to a low profile modular jack mounted on a printed circuit board.

2. Description of the Related Art

Electrical connectors known as modular plugs and modular jacks have come into widespread use in the telecommunications industry, and have also come into wide use as general interconnect devices for various pieces of electrical equipment. As utilized herein, the terms "modular jack" and "modular plug" connote generally the type of miniature, interchangeable, quick-connect-and-disconnect jacks and plugs developed by Western Electric Company and Bell Telephone Laboratories originally for use with telephone equipment. See, for example, U.S. Pat. Nos. 3,699,498; 3,850,497; and 3,860,316. Modular jacks have also been designed to allow direct coupling of a modular plug and its terminated cable to a printed circuit board (see, e.g., U.S. Pat. No. 4,210,376). Previously known modular plugs and jacks have been limited to having 4, 6 or 8 conductors.

Another field in which the general demand for electrical connectors is steadily increasing is that of computer equipment where each connector can be required to carry up to 30 or so conductors. Further, computer equipment frequently incorporates closely-spaced arrays of printed circuit boards upon which a female connector or jack, normally having 20–30 pins, must be mounted. Due to the close spacing of the printed circuit boards (typically 0.50 inch), the female jacks, and consequently their mating plugs, must be of sufficiently low profile in order to be physically mountable on the boards.

It would be highly desirable if the mating plug and jack assembly for such closely-spaced arrays of printed circuit boards had a quick-connect-and-disconnect capability, and provided adequate strain relief for the cable terminated in the plug. An improved low profile, modular plug and jack assembly meeting these requirements is set forth in copending United States Application Ser. No. 434,637, filed concurrently herewith in the name of Stephen B. Bogese, II and entitled LOW PROFILE MODULAR PLUG AND JACK ASSEMBLY. The foregoing copending application is expressly incorporated herein by reference.

As a result of more and more stringent interference emission regulations being promulgated by the Federal Communications Commission, it is becoming increasingly important to be able to provide connector systems for computer equipment with shielded cables. Prior art designs for low profile connectors have, unfortunately, been deficient in not being able to easily terminate a shielded cable, and at the same time maintain a quick-connect-and-disconnect capability.

Being able to fit a multi-conductor shielded cable within a low profile modular plug has also been somewhat of a problem due to the small dimensions required of the assembly, and the small space within which the individual wires of the cable can be manipulated. It would thus be highly desirable to provide a cable for housing up to, for example, 30 shielded conductors in a uniform outer jacket so that it may be more easily received, retained and terminated within the plug.

SUMMARY OF THE INVENTION

The foregoing and other objects are attained in accordance with one aspect of the present invention through the provision of a male connector which comprises a low profile, modular plug for terminating a multi-conductor cable and having a top wall, a bottom wall, opposed side walls and a plurality of substantially planar contact terminals oriented parallel to the side walls, latching arms extending outwardly and rear-wardly from the side walls and adapted to be releasably engaged with keeper means on the inner side walls of a mating, low profile modular jack, and door means formed in the bottom wall for providing access to the multi-conductor cable within the plug.

More particularly, the door means is formed adjacent the cable-receiving end of the plug and is pivotally mounted to the bottom wall by a reduced thickness portion of plastic.

In accordance with other aspects of the present invention, the door preferably includes means formed integrally thereon for increasing the pullout retention force of the cable. Such means preferably comprises a plurality of projections extending outwardly from the door into the cavity means during use for contacting the jacket of the cable.

In accordance with yet another aspect of the present invention, there is provided an electrical connector for terminating a cable having a plurality of conductors and for making electrical contact with a mating jack, which comprises a dielectric housing having a free end adapted to be inserted into the mating jack, a cable-receiving end including cavity means for receiving the cable, the cavity means extending within the housing towards the free end, and parallel, opposed top and bottom walls connected at their lateral edges by parallel opposed side walls, the bottom wall including means formed therein at the cable-receiving end thereof for providing access to the cable conductors in the cavity. A multiplicity of electrically conductive contact terminals extend through the cavity means for making electrical engagement with associated conductors of the cable and include an external surface for making electrical contact with spring contact wires of the mating jack. The contact terminals comprise substantially planar metallic elements oriented perpendicularly to the top and bottom walls and parallel to the side walls of the housing. The connector is further characterized by means extending integrally from at least one of the side walls of the housing, and preferably both side walls of the housing, for releasably securing the connector within the mating jack.

The cavity means in the housing may also include recess means formed therein for accommodating a preset number of insulated conductors or wire bundles therein and may more particularly include means for receiving a multi-conductor (e.g., 30-wire) shielded cable therein, and means for receiving a plurality of individual cable bundles therein.

BRIEF DESCRIPTION OF THE DRAWINGS

The foregoing and other objects, aspects and features of the present invention will be more fully appreciated as the same becomes better understood from the following detailed description of the present invention when viewed together with the accompanying drawings, in which.

DETAILED DESCRIPTION OF THE PREFERRED EMBODIMENTS

Figure 1:
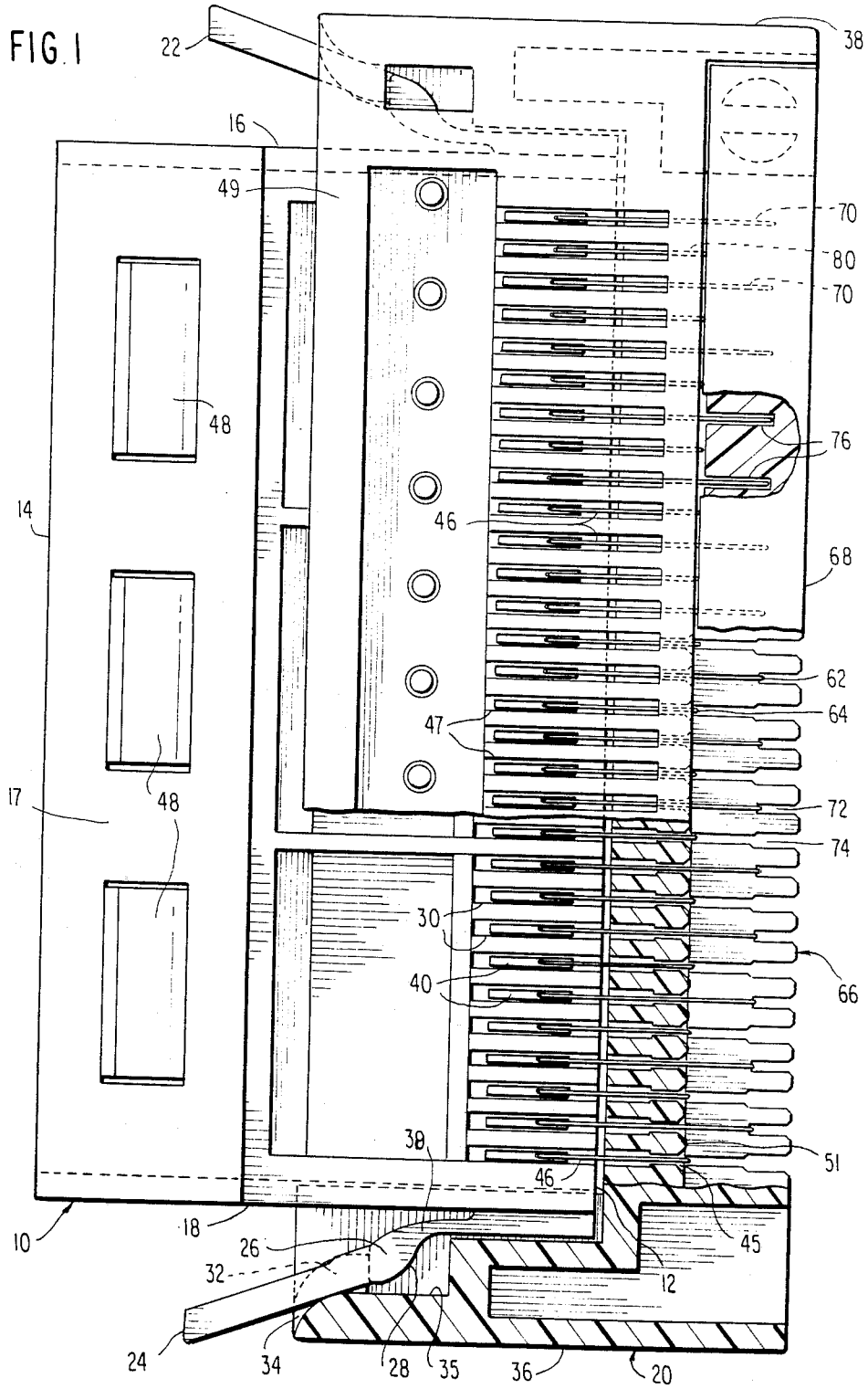
FIG. 1 is a top, plan view, partially broken, illustrating a preferred embodiment of a low profile modular plug fully inserted into a mating modular jack.

Referring now to the drawings, wherein like reference numerals represent identical or corresponding parts throughout the several views, and more particularly to FIG. 1, there is indicated generally by reference numeral 10 a low profile modular plug in accordance with one aspect of the present invention. Modular plug 10 is shown fully inserted into a mating, low profile modular jack 20. Modular plug 10 and modular jack 20 each comprise a one-piece or unipartite plastic housing, and the basic structures thereof are described in greater detail in copending Application Ser. No. 434,637, filed concurrently herewith and entitled LOW PROFILE MODULAR PLUG AND JACK ASSEMBLY by Stephen B. Bogese, II, such copending application being expressly incorporated by reference.

Modular jack 20 is designed to be mounted directly onto a printed circuit board (not shown) while the modular plug 10 is particularly designed to terminate a multi-conductor cable (not shown in FIG. 1). Jack 20 includes a pair of opposed, outer side walls 36 and 38 having a height much less than their length in order to provide the desired low profile. For example, side walls 36 and 38 may be approximately 0.30 inch high and 0.75 inch long. Such a height permits use of the low profile jack 20 on printed circuit boards stacked, for example, as close as 0.50 inch apart. Jack 20 includes a top wall 49 which has a lateral dimension or width which is generally much greater than its longitudinal dimension or length. For example, for the illustrated 30-pin jack, the lateral dimension of top wall 49 may be approximately 2.0 inches, while the length would be maintained at 0.75 inch.

On the inner side wall of jack 20, adjacent its plug-receiving opening, is formed a shoulder 34 having an outer cam face 32 and a recess 35 located rearwardly of shoulder 34. This structure cooperates with a latching arm assembly formed on the side wall of the mating plug, as will be described in greater detail hereinafter.

Modular jack 20 further includes a plurality of side-by-side conductors 70 and 80, each of which includes a spring contact portion 46 that extends through apertures 45 formed in rear wall 51. After emerging from apertures 45, spring contact portions 46 extend forwardly and upwardly through slots 47 in top wall 49. Conductors 70 and 80 also include solder tail portions 62 and 64, respectively, which extend downwardly through a rear ledge 66. Rear ledge 66 includes alternating shallow and deep recesses 72 and 74 for respectively receiving solder tails 62 and 64. A retaining cap 68 may also be provided, and preferably includes grooves 76 located to receive portions of conductors 70. Jack 20 is described in greater detail in the referenced copending application.

Figure 2:
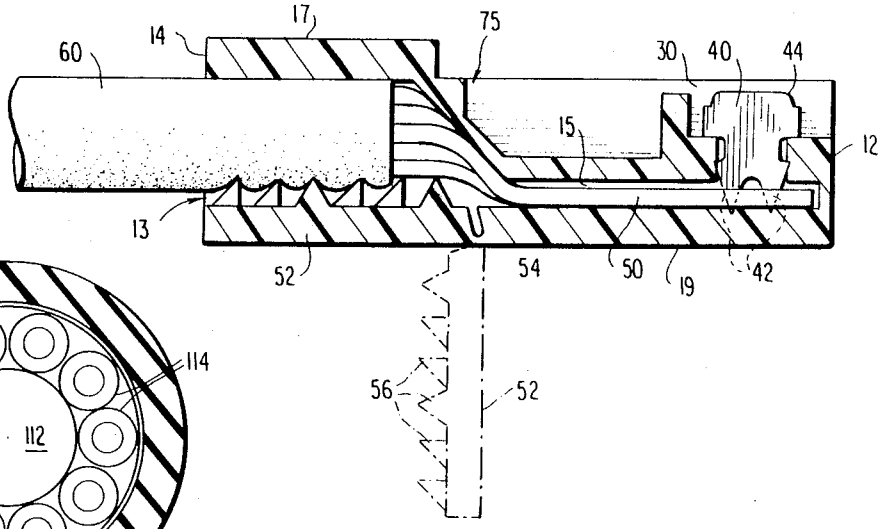
FIG. 2 is a longitudinal sectional view of the modular plug of FIG. 1 shown with a multi-conductor cable terminated therein.

Low profile modular plug 10 generally includes a free end 12 for insertion into the plug-receiving opening of jack 20, and a cable-receiving end 14. As shown in FIG. 2, a cable 60 is adapted to be positioned in a relatively large cable-receiving opening 13. Positioned adjacent large opening 13 are a plurality of smaller individual wire openings 15 for receiving the individually insulated or bare wires 50 of cable 60. The large cavity or opening 13 permits reception of, for example, a round cable 60. After the outer jacket of cable 60 is stripped back, its wires 50 may be flared out more or less in a planar array to enter the smaller, individual wire-receiving cavities 15. Cavities 15 are formed in the free-end portion 12 of plug 10 that must be thin enough (e.g., 0.23 inch) to mate with low profile jack 20.

Plug 10 further includes opposed outer side walls 16 and 18 and top and bottom walls 17 and 19, respectively. For the illustrated embodiment, a pair of latching arms 22 and 24 respectively extend outwardly and rearwardly from side walls 16 and 18 adjacent the free end portion 12 thereof.

Each latching arm, such as latching arm 24, includes a latch portion 26 (FIG. 1) having an outer cam face 28 which is adapted to cooperate with cam face 32 of shoulder 34 of jack 20. A thin portion 38 of latching arm 24 provides a spring-like resiliency to the latching arm to bias it outwardly to the position shown in FIG. 1. When plug 10 is fully inserted within jack 20, as shown in FIG. 1, latch portion 26 is seated within recess 35. To remove the plug, latching arm 24 must be moved inwardly towards wall 18 until latch portion 26 clears shoulder 34.

For extremely wide plug and jack assemblies, such as the 30-pin assembly of FIG. 1, it is desirable to provide two latching arm assemblies 22 and 24 which are substantially identical and extend from opposite side walls 16 and 18 of plug 10. For narrower assemblies, such as a 10-pin assembly (not shown), it may be sufficient to provide a single side latching arm assembly.

Plug 10 also includes a plurality of side-by-side slots 30 arranged laterally along the free end portion 12 thereof. Positioned within slots 30 are a plurality of substantially planar contact terminals 40. As best seen in FIG. 2, contact terminals 40 each include a pair of tangs 42 adapted to pierce the insulation of insulated wire 50 and make electrical contact with the center conductor thereof. Alternatively, tangs 42 may make direct electrical contact with a bare, uninsulated wire that may be positioned in cavity 15. Contact terminal 40 further includes an upper edge 44 which is adapted to make contact with spring portions 46 of the conductors 70, 80 of jack 20.

Modular plug 10 may also include a plurality of strain relief or cable-retention bars 48 (FIG. 1) which may either be moveable into or extend, permanently within the top portion of cavity 13.

Figure 3:
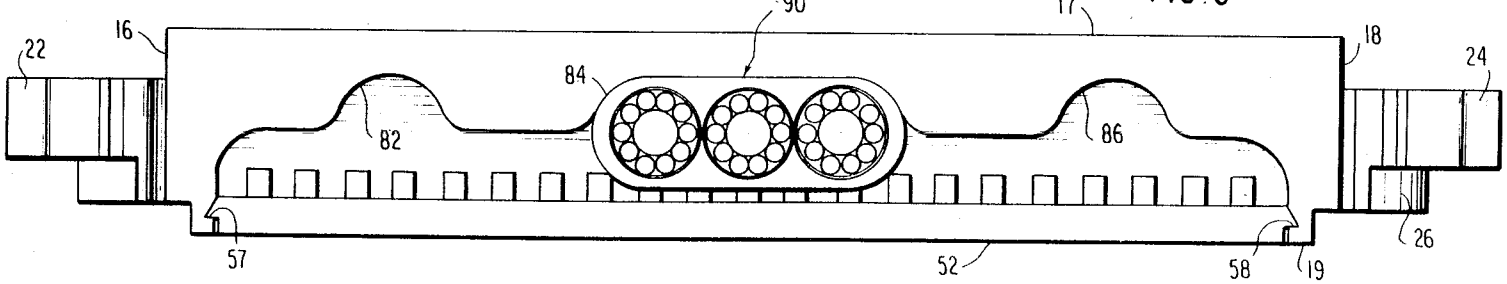
FIG. 3 is a transverse sectional view of a modular plug having a preferred embodiment of a multi-conductor shielded cable installed therein.

Referring now to FIGS. 2 and 3, bottom wall 19 of plug 10 preferably includes a door or lid 52 that forms the bottom wall of the large cable-receiving cavity 13 thereof. Door 52 is fastened to bottom wall 19 of plug 10 preferably by means of an integrally formed plastic hinge 54 or the like. This permits door 52 to be swung, for example, between its dotted line position and its solid line position as shown in FIG. 2. The lateral edges of door 52 may include a wedge-shaped latch as at 57 and 58 (FIG. 3) to provide a snap-fit with mating recesses in bottom wall 19.

A plurality of projections 56 are preferably provided on the inside surface of door 52. As seen in FIG. 2, when door 52 is closed, projections 56 will dig into cable jacket 60 to a certain degree. This results in an increase in the retention or pullout force of cable 60 when the door 52 is snapped shut as shown in FIG. 3.

Still referring to FIG. 3, the inside surface of top wall 17 of plug 10 may be provided with a plurality of longitudinally extending recesses 82, 84 and 86. Recesses 82 and 86 are preferably sized to enable a relatively small (for example, 10-wire) multi-conductor cable to be received therein for termination. In contrast, center recess 84 is preferably larger than recesses 82 and 86 to enable same to receive a relatively large (for example, 30-wire) multi-conductor cable such as the shielded cable indicated generally by reference numeral 90. Alternatively, of course, center recess 84 can accommodate a smaller multi-conductor cable than cable 90. The provision of the differently-sized recesses 82, 84 and 86 provides for great flexibility in adapting the plug 10 to be utilized in different applications.

Figure 4:
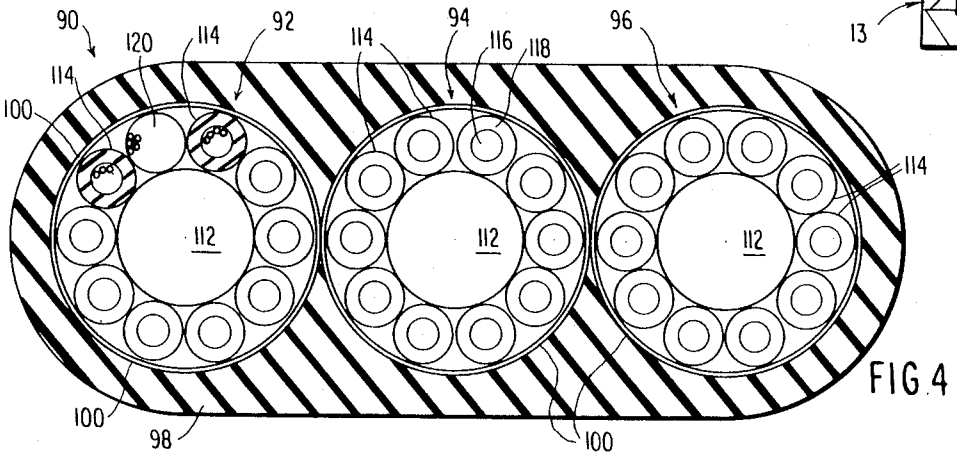
FIG. 4 is an enlarged, cross-sectional view showing the preferred embodiment of the multi-conductor shielded cable.

Referring now to FIG. 4, there is illustrated an enlarged, cross-sectional view of the 30-wire shielded cable 90. Multi-conductor cable 90 is seen to comprise a plurality of shielded wire assemblies 92, 94 and 96 which are all encased within a common outer insulating plastic jacket 98. Jacket 98 maintains shielded wire assemblies 92, 94 and 96 in a substantially planar array, and also maintains the shielded wire assemblies in electrical contact with each other.

Figure 5:
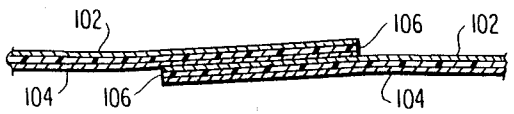
FIG. 5 is an enlarged, sectional view, partially broken, showing the overlapping nature of the outer shield of the shielded cable of the present invention.

Each shielded wire assembly includes an outer shield 100 which preferably comprises, as best seen in FIG. 5, an outer metal foil layer 102, an inner metal foil layer 104, and a central insulating layer 106 (for example, polyester) positioned between the outer and inner foil layers 102 and 104. In use, when wrapped about a wire assembly, outer metal foil layer 102 makes electrical contact with inner metal foil layer 104 at the overlapping portion thereof, as illustrated clearly in FIG. 5. Thus, the electrical potential on the inner layer 104 will be transmitted to the outer layer 102. The edges of the layers may be secured by a suitable adhesive.

The shielded wire assemblies 92, 94 and 96 further include a substantially cylindrical, centrally located filler or stay cord 112. Shielded wire assemblies 94 and 96 are substantially identical, and include a plurality (for example, ten) substantially cylindrical insulated conductors 114 which are about the same size. Each insulated conductor 114 includes a center conductor 116 surrounded by an insulating outer layer 118. In assemblies 94 and 96, the insulated conductors 114 extend in a single layer about filler 112, and shields 100 are wrapped about insulated conductors 114 so as to provide a pair of round multi-conductor assemblies.

Shielded wire assembly 92, however, differs from assemblies 94 and 96 in that assembly 92, while having a plurality (for example, nine) insulated conductors 114 arranged in a single layer about filler 112, also includes in that single layer a bare, uninsulated ground conductor or wire 120. Ground wire 120 is substantially the same diameter as any of the insulated conductors 114 to provide a uniform, balanced arrangement. If ground conductor 120 is externally connected at either end to a source of ground potential, the latter will be transmitted to the inner foil layer 104 of shield 100 by virtue of its contact therewith along its length. From inner layer 104, the ground potential will be transmitted to the outer foil layer 102 by virtue of the overlapping edge arrangement shown in FIG. 5. Since the adjacent shields 100 of assemblies 92, 94 and 96 contact one another, the ground potential will therefore be provided to all three shields 100.

When it is desired to terminate the multi-conductor shielded cable 90 in low profile plug 10, the outer jacket 98 and shields 100 of cable 90 are initially stripped back to a predetermined distance to leave the insulated conductors 114 and ground wire 120 exposed. The exposed portions of the conductors 114 in the outer shielded wire assemblies 92 and 96 are preferably made longer than the exposed portions of the center assembly 94 due to the greater distance between the outer assemblies 92, 96 and their respective wire-receiving cavities 15.

Door 52 of plug 10 is then opened, and the conductors 114 are each placed in a separate wire-receiving cavity 15. Ground wire 120 is placed in a pre-selected one of the cavities 15 where it is understood that an external ground connection will be provided. When the wires of conductors 114 and ground wire 120 are properly positioned in their respective cavities 15, they are electrically terminated by insertion of contact terminals 40 in slots 30. Door 52 may then be snapped shut to retain cable jacket 98 in place and to increase the pullout force.

The door 52 of plug 10 is particularly useful in terminating the multi-conductor shielded cable 90 in plug 10. Due to the centrally located input 84 of all of the wire assemblies 92, 94 and 96, their respective conductors 114, 120 must be flared out substantially laterally in the region of cavity 13 generally indicated in FIG. 2 by reference numeral 75 which is located forwardly of the cable jacket edge and rearwardly of the cavities 15. In order for the wires of conductors 114, 120 to be thusly manipulated to be positioned within their respective individual channels 15, the accessibility to cavity 13 provided by door 52 is extremely helpful. The final positioning of shielded cable 90 within plug 10, due to the accessibility afforded by door 52, also minimizes the emf window formed between the end of the shields and jacket and the interior of the plug, to therefore minimize emf leakage.

Obviously, numerous modifications and variations of the present invention are possible in light of the above teachings. It is therefore to be understood that within the scope of the appended claims, the invention may be practiced otherwise than as specifically described herein.

I claim:

1. A modular plug for terminating a cable having an outer jacket covering a plurality of conductors, and for making electrical contact with a mating modular jack, the mating modular jack including a plug-receiving opening with an arm-receiving recess and a plurality of spring contact members in the opening, the modular plug comprising:

a unipartite dielectric housing having opposed top and bottom walls, opposed side walls, a free end for insertion into the plug-receiving opening of the mating modular jack, a cable-receiving end having a relatively large cable-receiving opening for receiving the outer jacket of the cable, said cable-receiving opening defined by a floor, a ceiling and opposed inner side walls, relatively small conductor-receiving openings adjacent to and in communication with said cable receiving opening and extending to said free end for receiving and enclosing the individual conductors of the cable, said free end also including terminal-receiving slots extending through said top wall to said conductor-receiving openings;

a latching arm mounted on one of said side walls and extending angularly rearwardly from said free end of said housing for releasably mating with the arm-receiving recess in the modular jack;

substantially planar, electrically conductive contact terminals extending through said terminal-receiving slots and having insulation-piercing tangs at the lower portion thereof for terminating the conductors of the cable and an upper portion for making electrical contact with the spring contact members of the modular jack; and said bottom wall including means integrally formed therein for providing access to the cable in said cable-receiving opening, said access means comprising a door pivotally connected to said housing and forming when closed said floor of said cable-receiving opening, said access means including integral locking means for securing said door in its closed position.

2. A modular plug as set forth in claim 1, wherein said free end of said housing comprises a rigid, unipartite structure that encloses the ends of said conductors.

3. A modular plug as set forth in claim 1, wherein said door is pivotally mounted to said housing at the approximate junction between said cable-receiving opening and said conductor-receiving openings.

4. A modular plug as set forth in claim 3, wherein said door comprises that portion of said bottom wall that extends from said junction rearwardly towards said cable-receiving end.

5. A modular plug as set forth in claim 1, wherein said door comprises a portion of said bottom wall that extends from about the middle of said housing rearwardly towards said cable-receiving end.

6. A modular plug as set forth in claim 1, further comprising a second latching arm mounted on the other of said side walls and extending angularly rearwardly from said free end of said housing.

7. A modular plug as set forth in claim 1, wherein said door includes a plurality of projections extending from said floor for increasing the pullout force of the jacket of the cable.

8. The modular plug as set forth in claim 1, wherein the lateral dimension of said top and bottom walls is much larger than the longitudinal dimension thereof.

9. The modular plug as set forth in claim 1, wherein the height of said side walls is much less than the length thereof.

10. The modular plug as set forth in claim 1, wherein said plug has low profile means for permitting use of same with mating jacks mounted on printed circuit boards spaced apart about 0.50 inch.

11. The modular plug as set forth in claim 10, wherein said low profile means includes side walls of said plug having a height ranging between 0.20 inch and 0.30 inch.

12. The modular plug as set forth in claim 1, wherein said door includes means formed integrally thereon for increasing the retention force of the cable within said cable-receiving opening.

13. The modular plug as set forth in claim 12, wherein said integrally formed means comprises a plurality of projections extending outwardly from said door into said cable-receiving opening for contacting the jacket of the cable.

14. The modular plug as set forth in claim 1, wherein said cable-receiving opening includes a plurality of side-by-side cavity portions, each of said cavity portions adapted to receive a pre-set number of cable conductors.

15. The modular plug as set forth in claim 14, wherein each of said cavity portions includes a recess formed in said ceiling for accommodating said pre-set number of cable conductors.

16. The modular plug as set forth in claim 15, wherein said ceiling includes three such recesses, the center recess being sized to receive a 30-wire shielded cable for termination in said plug.

17. A modular plug for terminating a cable having an outer jacket covering a plurality of conductors, and for making electrical contact with a mating modular jack, the mating modular jack including a plug-receiving opening with an arm-receiving recess and a plurality of spring contact members in the opening, the modular plug comprising:

a unipartite dielectric housing having opposed top and bottom walls, opposed side walls, a free end for insertion into the plug-receiving opening of the mating modular jack, a cable-receiving end having a relatively large cable-receiving opening for receiving the outer jacket of the cable, said cable-receiving opening defined by a floor, a ceiling and opposed inner side walls, relatively small conductor-receiving openings adjacent to and in communication with said cable receiving opening and extending to said free end for receiving and enclosing the individual conductors of the cable, said free end also including terminal-receiving slots extending through said top wall to said conductor-receiving openings;

a latching arm mounted on one of said side walls and extending angularly rearwardly from said free end of said housing for releasably mating with the arm-receiving recess in the modular jack;

substantially planar, electrically conductive contact terminals extending through said terminal-receiving slots and having insulation-piercing tangs at the lower portion thereof for terminating the conductors of the cable and an upper portion for making electrical contact with the spring contact members of the modular jack; and said bottom wall including means integrally formed therein for providing access to the cable in said cable-receiving opening, said access means comprising a door pivotally connected to said housing and forming when closed said floor of said cable-receiving opening.

18. A modular plug as set forth in claim 17, wherein said free end of said housing comprises a rigid, unipartite structure that encloses the ends of said conductors.

19. A modular plug as set forth in claim 17, wherein said door is pivotally mounted to said housing at the approximate junction between said cable-receiving opening and said conductor-receiving openings.

20. A modular plug as set forth in claim 19, wherein said door comprises that portion of said bottom wall that extends from said junction rearwardly towards said cable-receiving end.

21. A modular plug as set forth in claim 17, wherein said door comprises a portion of said bottom wall that extends from about the middle of said housing rearwardly towards said cable-receiving end.

* * * * *